US012410944B2

(12) United States Patent
Beyhaghi et al.

(10) Patent No.: US 12,410,944 B2
(45) Date of Patent: Sep. 9, 2025

(54) WATER HEATING SYSTEM

(71) Applicant: Rheem Manufacturing Company, Atlanta, GA (US)

(72) Inventors: Saman Beyhaghi, Montgomery, AL (US); Atilhan Manay, Roswell, GA (US); Shubham Srivastava, Montgomery, AL (US); Qian Zhang, Montgomery, AL (US); Tobey Fowler, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 17/547,555

(22) Filed: Dec. 10, 2021

(65) Prior Publication Data

US 2022/0186981 A1 Jun. 16, 2022

Related U.S. Application Data

(60) Provisional application No. 63/124,180, filed on Dec. 11, 2020.

(51) Int. Cl.

| | |
|---|---|
| ***F22D 7/04*** | (2006.01) |
| ***F24H 1/18*** | (2022.01) |
| ***F24H 9/13*** | (2022.01) |
| ***F24H 9/14*** | (2006.01) |

(52) U.S. Cl.
CPC ..... *F24H 9/133* (2022.01); *F24H 1/18* (2013.01)

(58) Field of Classification Search
CPC . F22D 7/00; F22D 7/04; F24H 9/0042; F24H 9/14
See application file for complete search history.

(56) References Cited

U.S. PATENT DOCUMENTS 2,602,465 A * 7/1952 Goehring ..... B65D 88/54 239/524
5,341,770 A * 8/1994 Lannes ..... F24H 9/133 122/19.2
5,988,117 A * 11/1999 Lannes ..... F24H 9/133 122/159

(Continued)

FOREIGN PATENT DOCUMENTS

RU 56961 U1 9/2002
RU 2343954 C2 1/2009

(Continued)

OTHER PUBLICATIONS

International Search Report and Written Opinion of International Application No. PCT/US2021/062782 dated April 7. 2022.

*Primary Examiner* — Gregory A Wilson
(74) *Attorney, Agent, or Firm* — Eversheds Sutherland (US) LLP

(57) ABSTRACT

A water heating system having a tank and one or more heat sources for heating water is provided. The water heating system includes a water outlet for allowing egress of water from the tank and a dip tube for allowing ingress of water into the tank. The dip tube includes a first end for coupling with a water source and a second end disposed proximate a base of the tank for discharging water into the tank through an array of holes. Each of the holes is defined in a side wall of the dip tube and laterally discharges water with respect to a longitudinal axis of the second end of the dip tube.

14 Claims, 6 Drawing Sheets

(56) References Cited

U.S. PATENT DOCUMENTS

| | | | | |
|---|---|---|---|---|
| 6,138,614 | A * | 10/2000 | Shropshire | F24H 9/133<br>122/13.3 |
| 6,370,328 | B1 * | 4/2002 | Mottershead | F24H 9/0021<br>392/452 |
| 6,508,208 | B1 * | 1/2003 | Frasure | F24H 1/207<br>392/457 |
| 7,203,418 | B1 * | 4/2007 | York | F24H 1/202<br>392/441 |
| 7,861,678 | B2 * | 1/2011 | Mcclellan | F22D 7/04<br>122/429 |
| 10,094,592 | B2 * | 10/2018 | Lowdermilk | F24H 9/133 |
| 10,288,316 | B1 * | 5/2019 | Currey | F24H 9/45 |
| 10,465,942 | B2 * | 11/2019 | Shaffer | F24H 1/182 |
| 11,280,519 | B2 * | 3/2022 | Hutchison | F24H 9/0015 |
| 2016/0040906 | A1 * | 2/2016 | Aguilar | F24H 4/04<br>392/451 |

FOREIGN PATENT DOCUMENTS

| | | | |
|---|---|---|---|
| RU | 103740 | U1 | 4/2011 |
| RU | 111015 | U1 | 12/2011 |
| RU | 2649548 | C1 | 4/2018 |
| SU | 928137 | A1 | 5/1982 |
| WO | 2019209744 | A1 | 10/2019 |

* cited by examiner

WATER HEATING SYSTEM

CROSS-REFERENCE TO RELATED APPLICATIONS

This application claims the benefit, under 35 U.S.C. § 119, of U.S. Provisional Patent Application No. 63/124,180, filed 11 Dec. 2020, the entire contents and substance of which is incorporated herein by reference in its entirety as if fully set forth below.

TECHNICAL FIELD

The present disclosure relates, in general, to a water heater and, more specifically relates, to a dip tube used for receiving water into a tank of the water heater.

BACKGROUND

Water heaters are used to heat and store a quantity of water in a tank thereof for subsequent, on-demand delivery of hot water for residential and commercial use. Electric water heaters utilize heating elements to transfer heat to the water contained in the tank and can be controlled by thermostat devices that monitor temperature of the water in the tank. Further, the water heater includes a dip tube for receiving water from an external source into the tank and a bottom end of the dip tube is positioned at a bottom of the tank.

Generally, it is beneficial to maintain a uniform temperature of water within the tank. However, the water at the bottom of the tank tends to be at a lower temperature as the water from an external source is generally cooler when discharged at the bottom of the tank. The temperature rises as the level of water approaches a top of the tank. In a typical water heating system, the stream of colder water discharged from the bottom end of the dip tube may have higher momentum, and thereby the colder water may move upward at a greater velocity towards the warmer water present at the top of the tank. As a result, the colder water will mix with the hot water, and the overall temperature of the water at higher levels of the tank (near outlet) may get impacted (reduced at an undesirably fast rate). Relatedly, a first-hour rating (FHR) of the water heater, which is a measure of a volume of hot water that the water heater can supply in the first hour of operation, may be negatively impacted. The FHR is an industry-wide indicator (as measured by a standardized test) used to establish thermal efficiency of the water heater, and hence water heater manufacturers continually strive to increase the first-hour rating. Under the FHR test, water draws continue until the water outlet temperature of the tank decreases by 15 degree F. from its maximum value, which is typically observed within the first 30 seconds of that the initial draw.

SUMMARY

According to an aspect of the present disclosure, a water heating system is disclosed. The water heating system includes a tank and one or more heat sources in thermal communication with the tank. The one or more heat sources are configured to heat water within the tank. The water heating system further includes a water outlet configured to allow egress of water from the tank. The water heating system further includes a dip tube configured to allow ingress of water into the tank. The dip tube includes a first end configured to couple with a water source and a second end distal to the first end. The second end of the dip tube is disposed proximate a base of the tank and configured to discharge water to the tank through an array of holes. Each of the holes is defined in a side wall of the dip tube and is configured to laterally discharge water with respect to a longitudinal axis of the dip tube. The second end of the dip tube can be closed. A sum of cross-sectional area of each hole of the array of holes is greater than a cross-sectional area of the second end of the dip tube. Particularly, the sum of cross-sectional area of each hole of the array of holes is at least 50 percent higher than the cross-sectional area of the second end of the dip tube. The water heating system can further include one or more guide members disposed at an inner surface of the side wall of the dip tube and configured to guide discharge of the water through the array of holes.

In one embodiment, the array of holes includes one or more rows of holes radially defined around the longitudinal axis of the second end of the dip tube. Each row contains at least two holes defined at equilateral distance. In another embodiment, the array of holes includes a first row of holes proximate the second end of the dip tube and a second row of holes defined adjacent the first row of holes. Each hole of the second row is aligned at an approximate middle of two adjacent holes of the first row. In yet another embodiment, the array of holes includes one or more rows of holes radially defined around the longitudinal axis of the second end of the dip tube. Each row includes two or more holes defined with respect to a side portion of the side wall of the dip tube that does not contain any holes.

In an embodiment, the dip tube includes a body portion and an elongated portion defining the array of holes and the second end. The elongated portion is detachably coupled with the body portion of the dip tube. Each hole of the array of holes defined in the elongated portion is positioned to direct the water towards the wall of the tank. Further, each hole of the array of holes defined in the elongated portion is adapted to direct the water substantially along the horizontal plane. In one embodiment, the body portion is coaxially and vertically aligned with respect to the longitudinal axis of the second end of the dip tube. In another embodiment, the body portion is aligned perpendicular with respect to the longitudinal axis of the second end of the dip tube and parallel to the base of the tank. In yet another embodiment, a cross sectional area of the elongated portion tapers towards the base of the tank. In one embodiment, a cross sectional shape of each of the holes is a circle. In another embodiment, a cross sectional shape of each of the holes is a rectangle.

These and other aspects and features of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Figure 1:
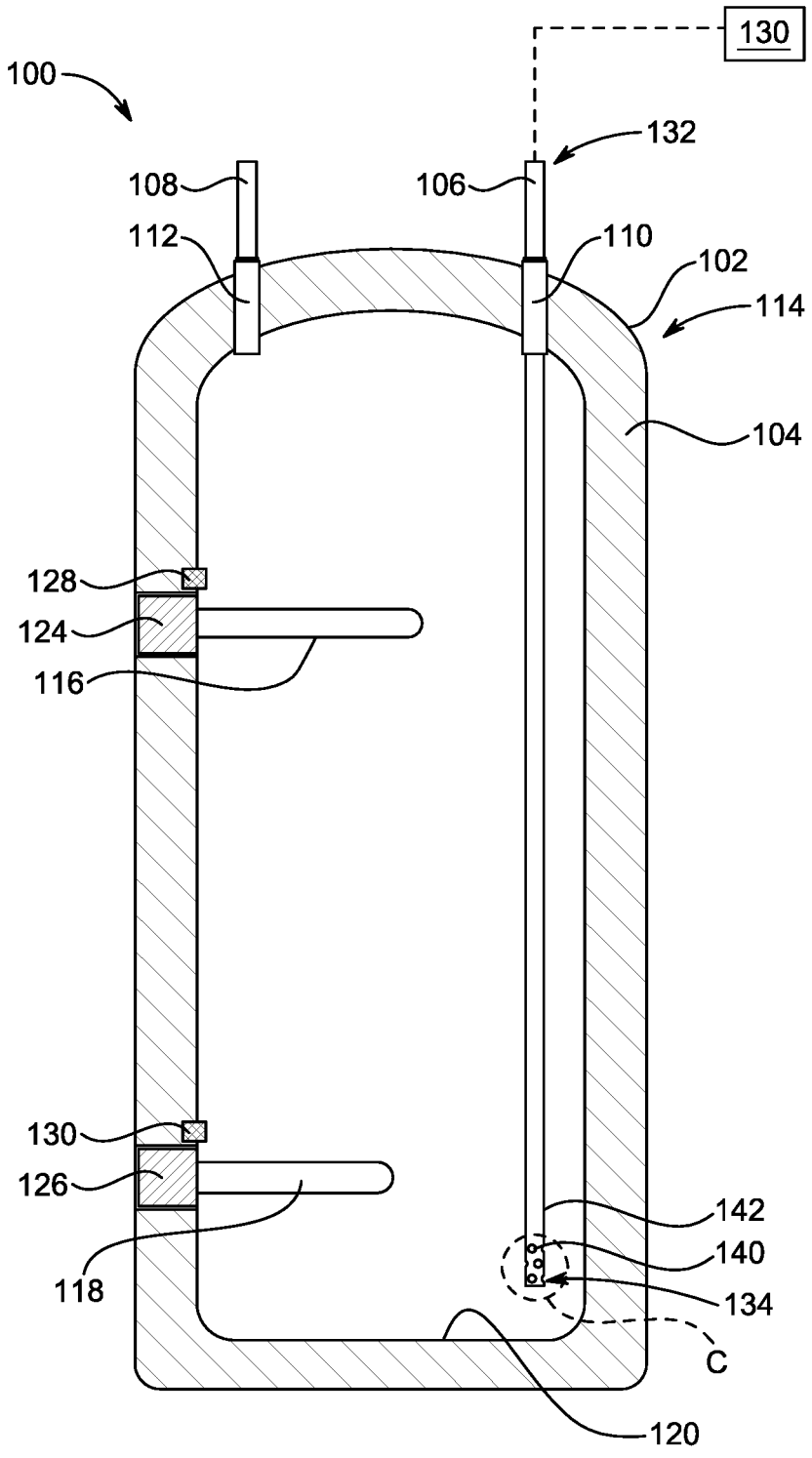
FIG. 1 is a cross-sectional view of a water heating system, according to an embodiment of the present disclosure.

Throughout this disclosure, various aspects of the disclosed technology can be presented in a range format (e.g., a range of values). It should be understood that such descriptions are merely for convenience and brevity and should not be construed as an inflexible limitation on the scope of the disclosed technology. Accordingly, the description of a range should be considered to have specifically disclosed all the possible subranges as well as individual rational numerical values within that range. For example, a range described as being "from 1 to 6" includes the values 1, 6, and all values therebetween. Likewise, a range described as being "between 1 and 6" includes the values 1, 6, and all values therebetween. The same premise applies to any other language describing a range of values. That is to say, the ranges disclosed herein are inclusive of the respective endpoints, unless otherwise indicated.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

In the following description, numerous specific details are set forth. But it is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to and are not intended to imply that the objects so described should be in a given sequence, either temporally, spatially, in ranking, or in any other manner.

Reference will now be made in detail to example embodiments of the disclosed technology, examples of which are illustrated in the accompanying drawings and disclosed herein. Wherever convenient, the same reference numbers will be used throughout the drawings to refer to the same or like parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Referring to FIG. 1, a cross-sectional view of a water heating system 100 is illustrated, according to an embodiment of the present disclosure. The water heating system 100 (hereinafter referred to as 'the system 100') includes a tank 102 having a wall 104. In an example, capacity of the system 100 may be, but is not limited to, 30, 40, 50, 55, 60, 75, 80, 85, or 100 gallons. The system 100 also includes a dip tube 106 and a water outlet 108 defined through the wall 104. An inlet fitting 110 and an outlet fitting 112 are provided in the wall 104, at a top end 114 of the tank 102, to respectively support the dip tube 106 and the water outlet 108 routed through the wall 104. The dip tube 106 is configured to allow ingress of water into the tank 102 and the water outlet 108 is configured to allow egress of water from the tank 102. Heated water is drawn from the tank 102 through the water outlet 108 with aid of, for example, a pump, and may be delivered to one or more end devices, such as laundry washers, dishwashers, faucets, and shower heads. In an embodiment, the wall 104 of the tank 102 may be insulated to retain heat of the water for longer duration.

The system 100 further includes one or more heat sources in thermal communication with the tank. The one or more heat sources can be or include any source of heat capable of heating water (e.g., one or more electrical heating elements, combustion-type heating, heat pump). As illustrated, the system can include one or more heating elements coupled to the wall 104 and configured to heat water. In an embodiment, a first heating element 116 is disposed proximate the top end 114 of the tank 102 and a second heating element 118 is disposed proximate a base 120 of the tank 102. The first heating element 116 and the second heating element 118 may be attached to the wall 104 using a first coupling 124 and a second coupling 126, respectively. Electric current supply to the first heating element 116 and the second heating element 118 may be routed through the first coupling 124 and the second coupling 126, respectively. The system 100 can further include a first thermostat 128 and a second thermostat 130 configured to sense temperature of water proximate the top end 114 and the base 120, respectively, of the tank 102. The first heating element 116 and the second heating element 118 can extend parallel to the base 120.

The dip tube 106 extends from the inlet fitting 110 downward towards the base 120 of the tank 102 to supply colder water to the tank 102. The dip tube 106 includes a first end 132 configured to couple with a water source 130 and a second end 134 distal to the first end 132. The second end 134 of the dip tube 106 is disposed proximate the base 120 of the tank 102, i.e., closer to the base 120 than to the top end 114 of the tank 102. The dip tube 106 is typically positioned adjacent to the wall 104 of the tank 102. The dip tube 106 may have a length defined between the first end 132 and the second end 134. In one embodiment, the length of the dip tube 106 may be in a range of about 50 inches to about 60 inches. In various embodiments, the length of the dip tube 106 may be defined based on various factors including, but not limited to, a height of the tank 102 and capacity of the system 100. In an embodiment, a cross-sectional shape of the dip tube 106 may be a circle. In some embodiments, the cross-sectional shape of the dip tube 106 may be an oval, an ellipse, or any polygon shape known in the art.

As the base 120 may develop scales over a period of use of the system 100, the second end 134 of the dip tube 106 is located at a predetermined height from the base 120 of the tank 102 to prevent being subjected to scaling or prevent any influence of such scaling on the intended function of the dip tube 106. The predetermined height of the dip tube 106 from the base 120 of the tank 102 may be defined based on various factors including, but not limited to, type of material, size and cross-sectional shape of the dip tube 106.

The dip tube 106 further includes an array of holes 140 defined at the second end 134 thereof and configured to discharge water to the tank 102 therethrough. Each of the holes 140 is defined in a side wall 142 of the dip tube 106 and the second end 134 of the dip tube 106 is closed. That is, the terminal, axial opening defined by the circumference of the dip tube 106 can be closed or sealed (e.g., end wall 144, shown in FIG. 2), while the side wall 142 contains a plurality of apertures 140 through which the water is discharged from the dip tube 106.

The array of holes 140 is configured to laterally discharge the water with respect to a longitudinal axis 'L' (shown in FIG. 2) of the second end 134 of the dip tube 106. In an embodiment, the array of holes 140 may include one or more rows of holes radially defined around the longitudinal axis 'L' of the dip tube 102, and each row may include at least two holes. Each hole of the array of holes 140 defined at the second end 134 of the dip tube 106 is positioned to direct the water towards the wall 104 of the tank 102. Particularly, the array of holes 140 defined at the second end 134 of the dip tube 106 is adapted to direct water substantially along a horizontal plane. The array of holes 140 may be defined in a desired pattern in the side wall 142 of the dip tube 106. The various embodiments of the desired patterns of the holes 140 will be described in detail herein below. The array of holes 140 defined in the side wall 142 may be otherwise referred to as lateral openings of the dip tube 106 and configured to discharge the water laterally within the tank 102 while restricting discharge of the water axially. With the array of holes 140, the water may discharge slowly and in a more horizontal and diffused manner compared to a vertical discharge of the water through an axial opening of the dip tube, in which the stream of colder water may achieve a higher momentum and may move upward at greater velocity towards the water outlet 108 after bouncing back from the base 120 of the tank 102.

In some embodiments, a sum of the cross-sectional area of each hole of the array of holes 140 is greater than a cross-sectional area of the dip tube 106 at the second end 134. As such, a larger quantity of water is discharged through the array of holes 140 substantially along a horizontal plane compared to a vertical discharge of the water through an axial opening of the dip tube 106. Further, the second end 134 of the dip tube 106 is terminally closed at end wall 144 to avoid discharging of the water along a longitudinal plane or vertically towards the base 120 of the tank 102. In another embodiment, the sum of the cross-sectional area of each hole of the array of holes 140 may be 50 percent higher than the cross-sectional area of the dip tube 106 at the second end 134. In one example, the sum of the cross-sectional area of each hole of the array of holes 140 may be at least double the cross-sectional area of the dip tube 106 at the second end 134. In another example, a ratio between the sum of the cross-sectional area of each hole of the array of holes 140 and the cross-sectional area of the dip tube 106 at the second end 134 may be in a range of about 4 to 6.

During operation, colder water is supplied into the tank 102 through the dip tube 106. The water discharges through the array of holes 140 defined at the second end 134 of the dip tube 106 laterally and in a diffused manner towards the base 120 of the tank 102. Due to the manner in which the array of holes 140 is arranged, the velocity of the water exiting the dip tube 106 reduces and the water flows generally horizontally in order to prevent the streams of colder water from mixing into the warm water present at the top end 114 of the tank 102. Each draw during the first hour rating (FHR) test ends when the temperature of water at the water outlet 108 drops by 15 degree F. from its maximum value, which is typically observed in the first 30 s of that the initial draw. With the dip tube 106 of the present disclosure, the velocity of colder water exiting the dip tube 106 is reduced (e.g., as compared to the traditional dip tubes with an open bottom end and no side holes). As a result, the cold water gets mixed with the existing hot water of the tank more slowly, and the temperature of the water at the water outlet 108 decreases slowly, effectively slowing down the outlet temperature drop and thereby increasing the first draw volume capacity, which ultimately increases the FHR of the tank 102.

In an embodiment, sensors (e.g., temperature sensors) may be located within the tank 102 to sense temperature of water in the tank 102. Accordingly, based on the water temperature, each of the first heating element 116 and the second heating element 118 may be operated to heat the water. Once the temperature of the water heated in the tank 102, sensed by the first thermostat 128 or the second thermostat 130 (which can include or be in communication with the temperature sensors), reaches a predetermined value, the water is drawn from the tank 102. With the dip tube 106 of the present disclosure, the first-hour rating (FHR) of the system 100 is increased by up to 10 percent or more, such as from about 1 percent to about 10 percent, as compared to known water heating systems (i.e., a system lacking the dip tube 106 and having a traditional dip tube with a terminal opening defined by the circumference of the second end of the dip tube). That is to say, the dip tube is configured to discharge the water such that a first hour rating of the water heater system with the dip tube is up to 10 percent greater than a first hour rating of the water heater system having a conventional dip tube.

Figure 2:
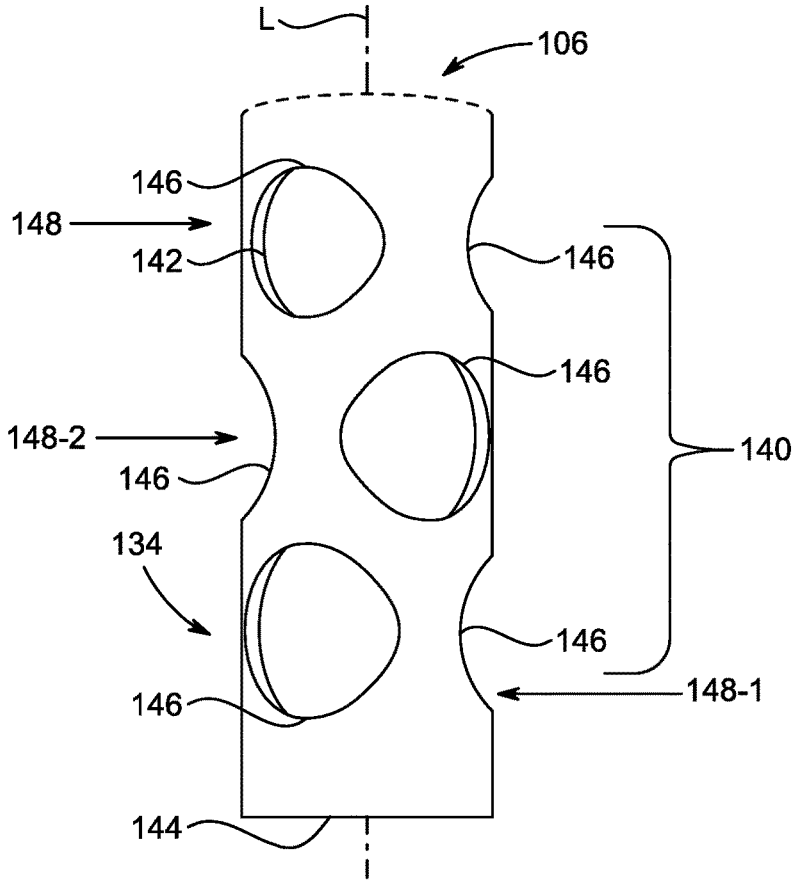
FIG. 2 is an enlarged view of a portion 'C' of a dip tube of the water heating system shown in FIG. 1, according to an embodiment of the present disclosure.

Referring to FIG. 2, an enlarged view of a portion 'C', specifically the second end 134 of the dip tube 106 shown in FIG. 1, is illustrated, according to an embodiment of the present disclosure. The dip tube 106 includes the side wall 142 and an end wall 144 defining a closed terminal end for the dip tube 106, thereby discharging the water axially from the second end 134 of the dip tube 106 is avoided. The dip tube 106 further includes the array of holes 140 defined in the side wall 142. Each hole of the dip tube 106 is individually referred to as 'the hole 146' and collectively referred to as 'the array of holes 140' or 'the plurality of holes 140' unless otherwise specifically mentioned.

The array of holes 140 can include a plurality (three are illustrated in FIG. 2) of rows of holes radially defined around the longitudinal axis 'L' of the second end 134 dip tube 106. Each row of holes may be individually referred to as 'the row of holes 148' or 'the row 148'. Each of the three rows 148 may be defined along a plane perpendicular to the longitudinal axis 'L' of the dip tube 106. In some embodiments, the array of holes 140 may include two or more rows of holes radially defined around the longitudinal axis 'L' of the dip tube 106. A distance between the two adjacent rows of the holes 148 may be defined based on various factors including, but not limited to, cross sectional area of the dip tube 106, the length of the dip tube 106 and the capacity of the tank 102.

Each row 148 can include a plurality (three are illustrated in FIG. 2) of holes 146 defined at equilateral distance. In the embodiment of FIG. 2, each of the three holes 146 of each row 148 is positioned 120 degrees apart from each other. A cross-sectional shape of the hole 146 is a circle, although other shapes may also be used, as described below.

In certain embodiments, the diameter of the hole 146 may be scaled up or down proportionally based on the diameter of dip tube 106. In an embodiment, the diameter of the dip tube 106 at the second end 134 may be in a range of about 18 mm to 22 mm. For a 19 mm diameter dip tube 106, at least 12 mm diameter holes may be defined at the side wall 142. Further, the diameter of the hole 146 may be in a range of about 60 to 70 percent of the diameter of the dip tube 106. In another example, the diameter of the holes 146 may be in a range of about 12 mm to 15 mm.

In an alternate embodiment, each row 148 may include two holes 146, and each of the two holes 146 may be positioned 180 degrees apart from each other. In such a case, the diameter of the hole 146 may be in a range of about 15 mm to 20 mm. Further, the diameter of the hole 146 may be defined in a range of about 70 to 90 percent of the diameter of the dip tube 106. In some embodiments, each row 148 may include four holes 146, and each of the four holes 146 may be positioned 90 degrees apart from each other.

In an alternate embodiment, the cross-sectional shape of the hole 146 may be a rectangle. In certain embodiments, the cross-sectional shape of the hole 146 may be an oval, an ellipse, or any polygon shape known in the art.

In certain embodiments, as illustrated in FIG. 2, the array of holes 140 includes a first row of holes, alternatively referred to as 'the first row 148-1' and a second row of holes, alternatively referred to as 'the second row 148-2', defined adjacent the first row of holes. Particularly, the first row 148-1 is defined proximate the end wall 144 and the second row 148-2 is defined above the first row 148-1. Each hole 146 of the second row 148-2 is aligned midway between two adjacent holes 146 of the first row 148-1. In one example, each of the first row 148-1 and the second row 148-2 includes three holes 146 at 120 degrees apart, and each hole 146 of the second row 148-2 is offset by 60 degrees radially with respect to each hole 146 of the first row 148-1. In another example, each of the first row 148-1 and the second row 148-2 may include two holes at 180 degrees apart, and each hole 146 of the second row 148-2 may be offset by 90 degrees radially with respect to each hole 146 of the first row 148-1. In yet another example, each of the first row 148-1 and the second row 148-2 may include four holes 146 at 90 degrees apart, and each hole 146 of the second row 148-2 may be offset by 45 degrees radially with respect to each hole 146 of the first row 148-1.

Figure 3:
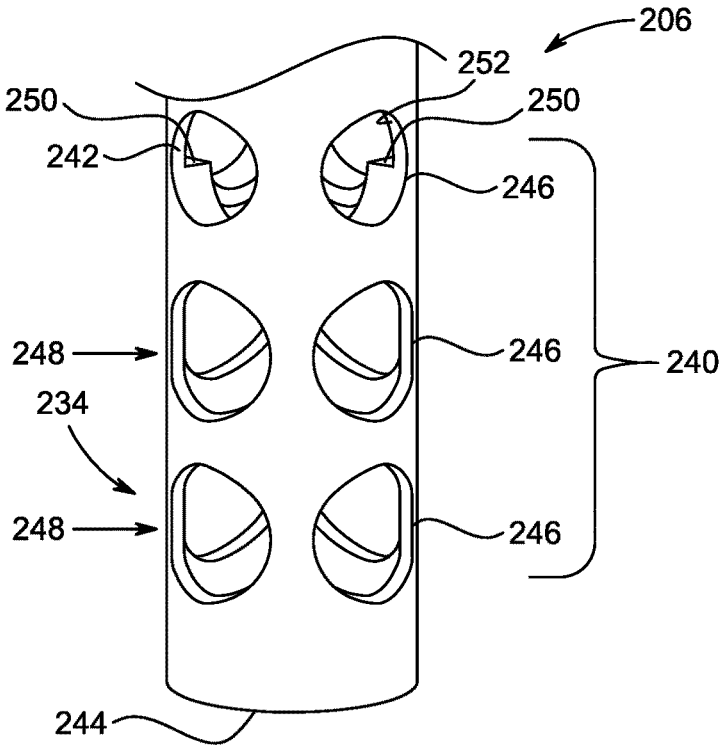
FIG. 3 is an enlarged view of a second end of a dip tube having an array of holes, according to one embodiment of the present disclosure.

Referring to FIG. 3, an enlarged view of a second end 234 of a dip tube 206 is illustrated, according to an embodiment of the present disclosure. The dip tube 206 includes a side wall 242 and an end wall 244 defining a closed terminal end for the dip tube 206. The dip tube 206 further includes an array of holes 240 defined in the side wall 242. The array of holes 240 includes three rows of holes 248 radially defined around a longitudinal axis of the dip tube 206. Each of the three rows 248 may be defined along a plane perpendicular to the longitudinal axis of the dip tube 206. Each row 248 includes four holes 246 defined at equilateral distance. Particularly, each of the four holes 246 is positioned 90 degrees apart from each other. Further, the holes 246 of each of the three rows 248 are aligned vertically and thereby define four individual columns of the holes 246, and thus a symmetrical orientation of the hole 246 is achieved at the second end 234 of the dip tube 206. A sum of cross-sectional area of each hole of the array of holes 240 is greater than a cross-sectional area of the dip tube 106. A cross-sectional shape of the hole 246 is a circle, and diameter of the dip tube 206 may be in a range of about 18 mm to 22 mm. In an example, for a 19 mm diameter dip tube 206, at least 12 mm diameter holes 246 may be defined at the side wall 242. In an alternative embodiment, the cross-sectional shape of the hole 246 may be a rectangle. In certain embodiments, the cross-sectional shape of the hole 246 may be an oval, an ellipse, or any polygon shape known in the art.

A distance between the two adjacent rows 248 may be defined based on various factors including, but not limited to, cross sectional area of the dip tube 206, a length of the dip tube 206 and the capacity of the tank 102.

In certain embodiments, the dip tube 206 further includes one or more guide members 250 disposed at an inner surface 252 of the side wall 242. In various embodiments, the one or more guide members 250 may be oriented perpendicular, or at an inclination, with respect to the inner surface 252 of the side wall 242 to guide discharge of the water through the array of holes 240. Particularly, the one or more guide members 250 may be provided at a bottom peripheral edge of the holes 246 of the row that is distal from the end wall 244 of the dip tube 206. In an alternate embodiment, the one or more guide members 250 may be provided at a bottom peripheral edge of each hole 246 of each row 248.

Figure 4:
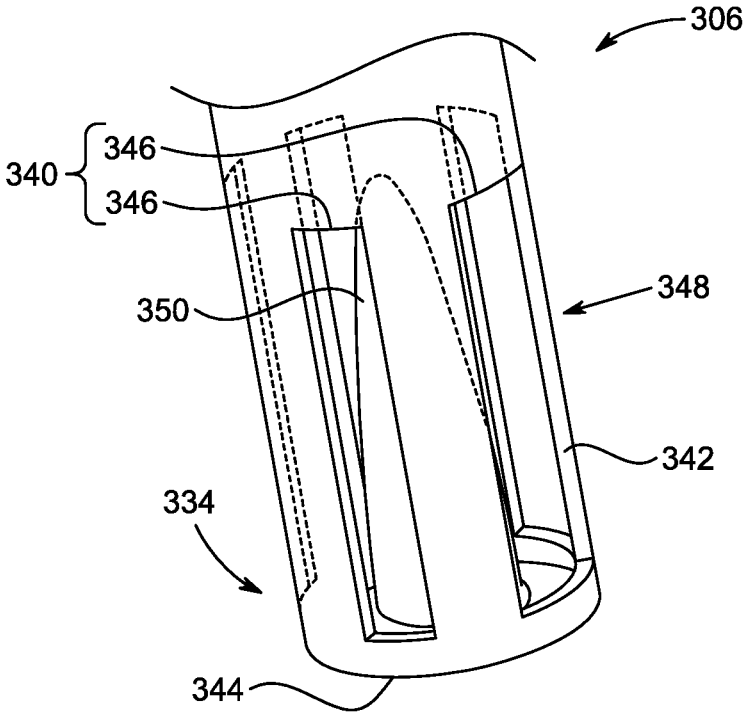
FIG. 4 is an enlarged view of a second end of a dip tube having an array of slots, according to another embodiment of the present disclosure.

Referring to FIG. 4, an enlarged view of a second end 334 of a dip tube 306 is illustrated, according to an embodiment of the present disclosure. The dip tube 306 includes a side wall 342 and an end wall 344 defining a closed terminal end for the dip tube 306. The dip tube 306 further includes an array of slots 340 defined in the side wall 342. The array of slots 340 includes one row of slots 348 radially defined around a longitudinal axis of the dip tube 306. The row 348 may be defined along a plane perpendicular to the longitudinal axis of the dip tube 306 at the second end 334. The row 348 includes multiple slots 346 and each of the multiple slots 346 may be defined at equilateral distance. In an example, the row 348 may include three to five slots 346. Each slot 346 has a rectangular cross-sectional shape, in which a longer length of the slot 346 is aligned parallel to the longitudinal axis of the dip tube 306 at the second end 334. A cross-sectional shape of the dip tube 306 is a circle. A sum of cross-sectional area of each hole of the array of holes 340 is greater than a cross-sectional area of the dip tube 106. The dip tube 306 may further include a conical protrusion 350 extending inwardly from the end wall 344 (e.g., extending vertically upward). The conical protrusion 350 may have a height equal to or greater than the longer length of the slot 346. The longer length and a width of each slot 346 may be defined based on various factors including, but not limited to, cross sectional area of the dip tube 306, length of the dip tube 306 and the capacity of the tank 102.

Figure 5:
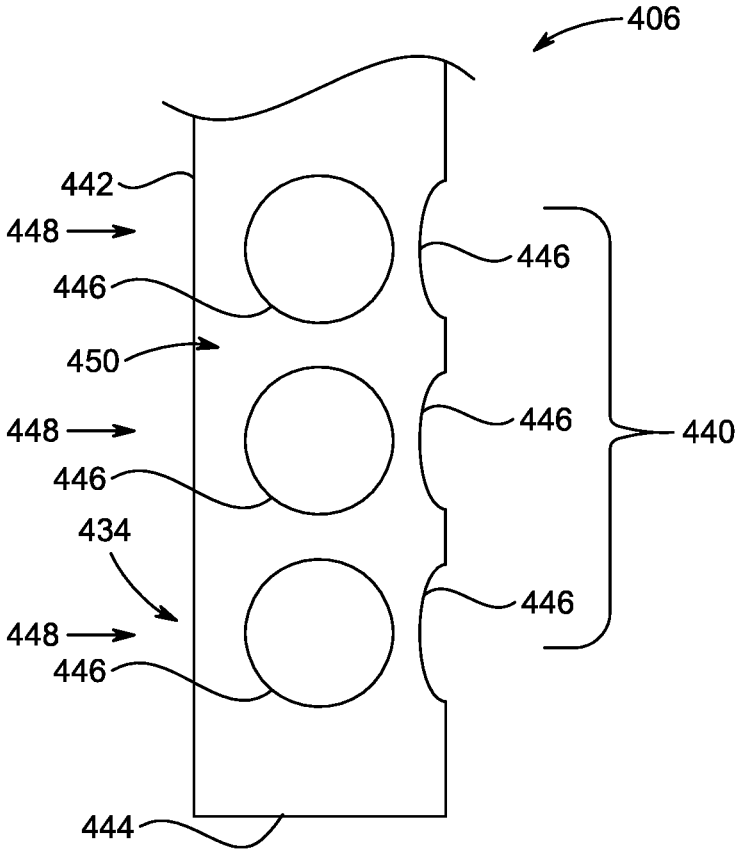
FIG. 5 is an enlarged view of a second end of a dip tube having an array of holes, according to yet another embodiment of the present disclosure.

Referring to FIG. 5, an enlarged view of a second end 434 of a dip tube 406 is illustrated, according to an embodiment of the present disclosure. The dip tube 406 includes a side wall 442 and an end wall 444 defining a closed terminal end for the dip tube 406. The dip tube 406 further includes an array of holes 440 defined in the side wall 442. The array of holes 440 includes three rows of holes 448 radially defined around a longitudinal axis of the second end 434 of the dip tube 406. Each row 448 may be defined along a plane perpendicular to the longitudinal axis of the second end 434 of the of the dip tube 406. Each row 448 includes three holes 446 defined with respect to a side portion 450 of the side wall 442 containing no holes. As such, the array of holes 440 define an asymmetric orientation of the holes 446. A visual indicator (not shown) may be provided in the dip tube 406 to indicate the side portion 450 of the side wall 442 such that, during assembly of the system 100, the dip tube 406 may be inserted into the tank 102 to face the side portion 450 of the side wall 442 to the closest inner surface portion of the tank 102. That is to say, the dip tube 406 can be oriented such that no holes are located on the side of the dip tube 406 that is facing the closest inner surface portion of the tank 102. Stated otherwise, the side of the dip tube 406 that is nearest the inner surface portion of the tank 102 can omit and/or be free of any holes. As such, the holes can be configured to direct water flow away from the closest inner surface portion of the tank 102.

Further, each of the three holes 446 of each row 448 is positioned 90 degrees apart from each other. The holes 446 of each of the three rows 448 are aligned vertically to define three individual columns of holes 446. A sum of cross-sectional area of each hole of the array of holes 440 is greater than a cross-sectional area of the dip tube 106. A cross-sectional shape of the hole 446 is a circle, and diameter of the dip tube 406 may be in a range of about 18 mm to 22 mm. In an example, for a 19 mm diameter dip tube 406, at least 12 mm diameter holes 446 may be defined at the side wall 442. In an alternate embodiment, the cross-sectional shape of the hole 446 may be a rectangle. In certain embodiments, the cross-sectional shape of the hole 446 may be an oval, an ellipse, or any polygon shape known in the art.

Figure 6A:
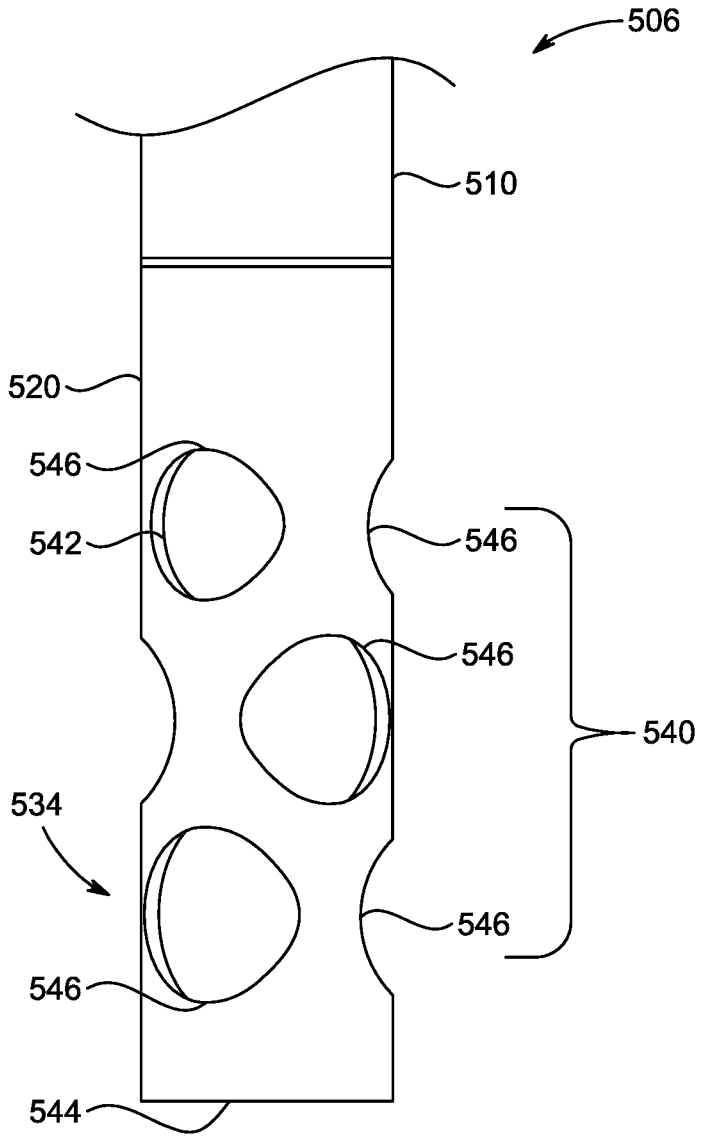
FIG. 6A is an enlarged view of a second end of a dip tube having a vertically disposed elongated portion, according to an embodiment of the present disclosure.

Referring to FIG. 6A, an enlarged view of a second end 534 of a dip tube 506 is illustrated, according to an embodiment of the present disclosure. The dip tube 506 includes a body portion 510 and an elongated portion 520 defining an array of holes 540 and the second end 534. The elongated portion 520 is detachably coupled with the body portion 510 of the dip tube 506. For example, the body portion 510 may define or be coupled to the first end of the dip tube 506 that is configured to couple with a water source. The elongated portion 520 includes a side wall 542 and an end wall 544 defining a closed terminal end for the dip tube 506. The array of holes 540 is defined in the side wall 542 of the elongated portion 520. In this embodiment, the elongated portion 520 is coaxially and vertically aligned with respect to a longitudinal axis of the body portion 510 of the dip tube 506. In one embodiment, the elongated portion 520 may be attached to the body portion 510 using a snap fit mechanism or an interference fit. In another embodiment, the elongated portion 520 may be threadably attached to the body portion 510. The array of holes 540 defined in the elongated portion 520 may be identical to the array of holes 140, 240, 440 and the array of slots 340 explained with reference to FIG. 2, FIG. 3, FIG. 5, and FIG. 4, respectively. Each hole 546 of the array of holes 540 defined in the elongated portion 520 is positioned to direct the water towards the wall 104 of the tank 102. Further, each hole 546 of the array of holes 540 defined in the elongated portion 520 is adapted to direct the water substantially along the horizontal plane. With this arrangement of the elongated portion 520, during service or maintenance of the system 100, just the elongated portion 520 may be replaced with a new elongated portion instead of replacing the entire dip tube 506 if the elongated portion 520 malfunctions due to manufacturing defects or gets worn out after longer use of the system 100. Thus, the service and maintenance of the system 100 becomes more efficient and cost effective.

Figure 6B:
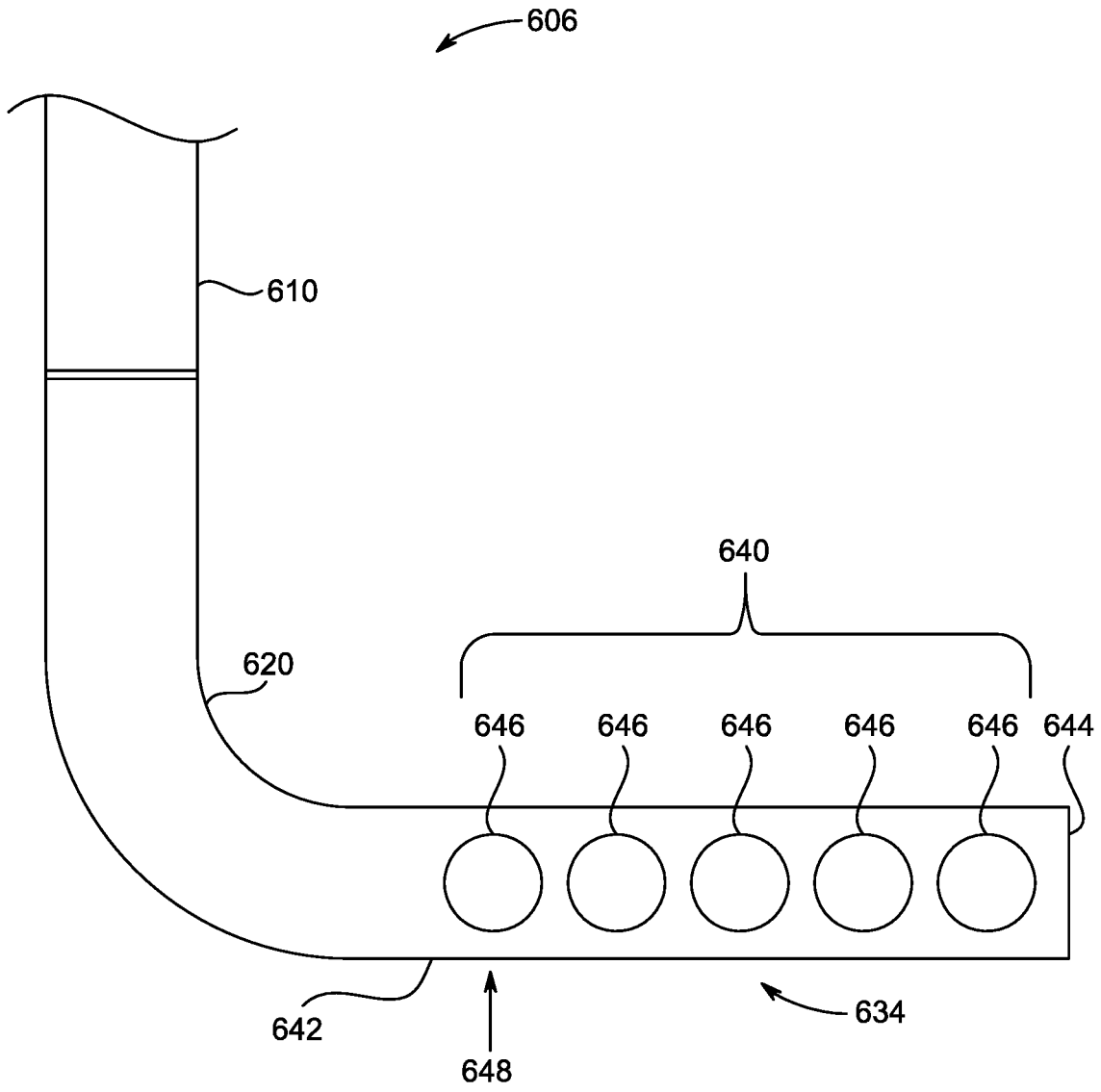
FIG. 6B is an enlarged view of a second end of a dip tube having a laterally disposed elongated portion, according to an embodiment of the present disclosure.

Referring to FIG. 6B, an enlarged view of a second end 634 of a dip tube 606 is illustrated, according to an embodiment of the present disclosure. The dip tube 606 includes a body portion 610 and an elongated portion 620 defining an array of holes 640 and the second end 634. The elongated portion 620 includes a side wall 642 and an end wall 644 defining a closed terminal end for the dip tube 606. In one embodiment, the elongated portion 620 may be detachably coupled with the body portion 610 of the dip tube 606. In another embodiment, the elongated portion 620 may be integral with the body portion 610 to define a single body for the dip tube 606. The body portion 610 is aligned perpendicular with respect to a longitudinal axis of the second end 634 of the dip tube 606 and parallel to the base 120 of the tank 102. As shown in FIG. 6B, the elongated portion 620 may include a bend or elbow section between the body portion 610 and the second end 634 of the dip tube 606.

The array of holes 640 is defined in the side wall 642 of the elongated portion 620. The array of holes 640 includes multiple rows of holes 648 radially defined around a longitudinal axis of the second end 634 of the elongated portion 620. Each row 648 may be defined along a plane perpendicular to the longitudinal axis of the second end 634 of the elongated portion 620. Each row 648 includes two holes 646 positioned at 180 degrees apart from each other. In another example, the two holes 646 of each row 648 may be positioned at 160 to 180 degrees apart from each other such that the holes 646 may be aligned tangential along a periphery of the side wall 642 of the dip tube 606. Further, the holes 646 of each row 648 are aligned vertically and thereby define two individual columns of the holes 646, and thus a symmetrical orientation of the holes 646 is achieved at the second end 634 of the dip tube 606. A cross-sectional shape of the hole 646 is a circle. In an alternate embodiment, the cross-sectional shape of the hole 646 may be a rectangle. In certain embodiments, the cross-sectional shape of the hole 646 may be an oval, an ellipse, or any polygon shape known in the art. Further, the array of holes 640 defined in the elongated portion 620 may be identical to the array of holes 140, 240, 440 and the array of slots 340 explained with reference to FIG. 2, FIG. 3, FIG. 5, and FIG. 4, respectively. Each hole 646 of the array of holes 640 defined in the elongated portion 620 is positioned to direct the water towards the wall 104 of the tank 102. Further, each hole 646 of the array of holes 640 defined in the elongated portion 620 is adapted to direct the water substantially along the horizontal plane.

Figure 6C:
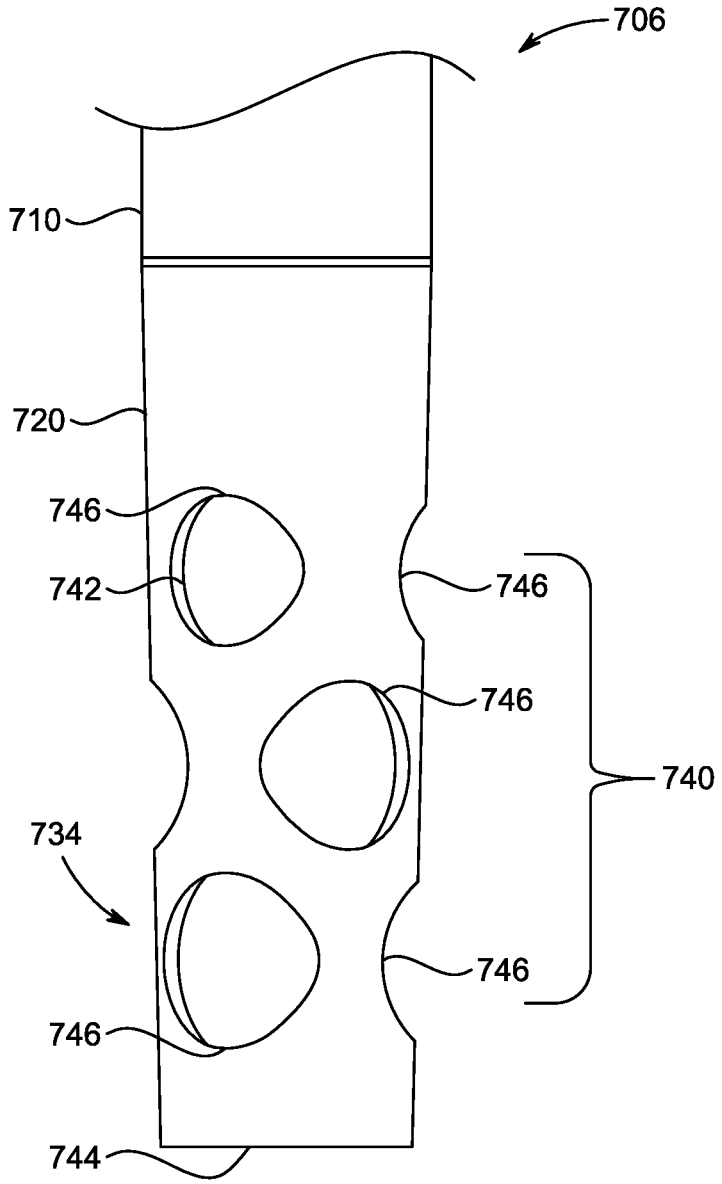
FIG. 6C is an enlarged view of a second end of a dip tube having a tapered elongated portion, according to an embodiment of the present disclosure.

Referring to FIG. 6C, an enlarged view of a second end 734 of a dip tube 706 is illustrated, according to an embodiment of the present disclosure. The dip tube 706 includes a body portion 710 and an elongated portion 720 defining an array of holes 740 and the second end 734. The elongated portion 720 includes a side wall 742 and an end wall 744 defining a closed terminal end for the dip tube 706. In one embodiment, the elongated portion 720 may be detachably coupled with the body portion 710. In another embodiment, the elongated portion 720 may be integral with the body portion 710 to define a single body for the dip tube 706. The elongated portion 720 is coaxially and vertically aligned with respect to a longitudinal axis of the body portion 710. The elongated portion 720 has a cross sectional area that tapers towards the base 120 of the tank 102. Particularly, for an elongated portion having a circular cross-section, a diameter defined by the side wall 742 may progressively decrease towards the end wall 744. The array of holes 740 is defined in the side wall 742 of the elongated portion 720. The array of holes 740 defined in the elongated portion 720 may be identical to the array of holes 140, 240, 440 and the array of slots 340 explained with reference to FIG. 2, FIG. 3, FIG. 5, and FIG. 4, respectively. Each hole 746 of the array of holes 740 defined in the elongated portion 720 is positioned to direct the water towards the wall 104 of the tank 102. Further, each hole 746 of the array of holes 740 defined in the elongated portion 720 is adapted to direct the water substantially along the horizontal plane.

While aspects of the present disclosure have been particularly shown and described with reference to the embodiments above, it will be understood by those skilled in the art that various additional embodiments may be contemplated by the modification of the disclosed methods without departing from the spirit and scope of what is disclosed. Such embodiments should be understood to fall within the scope of the present disclosure as determined based upon the claims and any equivalents thereof.

What is claimed is:

1. A water heating system comprising:

a tank;

one or more heat sources in thermal communication with the tank and configured to heat water within the tank;

a water outlet configured to allow egress of water from the tank; and a dip tube configured to allow ingress of water into the tank, comprising:

a body portion defining a first end configured to couple with a water source; and an elongated portion defining a second end distal to the first end and disposed proximate a base of the tank and configured to discharge the water to the tank substantially along a horizontal plane through an array of circular holes, the second end comprising an end cap configured to terminally close the second end and prevent vertical discharge of the water therefrom;

wherein the array of holes comprises three rows of holes defined around a longitudinal axis of the dip tube, wherein each row of holes comprises three holes and is radially offset 60° from each adjacent row of holes; and wherein the body portion is axially and vertically aligned with respect to the longitudinal axis of the elongated portion and the second end of the dip tube.

2. The water heating system of claim 1, wherein each of the three holes within each row of holes are defined at equilateral distances about a circumference of the second end of the dip tube.

3. The water heating system of claim 2, wherein the rows of holes are evenly spaced.

4. The water heating system of claim 3, wherein the adjacent holes of each row are positioned 120° apart.

5. The water heating system of claim 1, wherein each hole of the second row is aligned at an approximate middle of two adjacent holes of the first row.

6. The water heating system of claim 1, wherein the dip tube comprises one or more guide members disposed at an inner surface of a side wall thereof and configured to guide discharge of the water through the array of holes.

7. The water heating system of claim 1, wherein the elongated portion is detachably coupled with the body portion of the dip tube.

8. The water heating system of claim 1, wherein each hole of the array of holes defined in the elongated portion is positioned to direct water away from a wall of the tank.

9. The water heating system of claim 1, wherein a cross sectional area of the elongated portion tapers towards the base of the tank.

10. The water heating system of claim 1, wherein a sum of cross-sectional area of each hole of the array of holes is greater than a cross-sectional area of the second end of the dip tube.

11. The water heating system of claim 1, wherein a sum of cross-sectional area of each hole of the array of holes is at least 50 percent higher than a cross-sectional area of the second end of the dip tube.

12. The water heating system of claim 1, wherein the dip tube includes a conical protrusion extending inwardly from the second end.

13. The water heating system of claim 1, wherein a side portion of a side wall of the dip tube nearest an inner surface of the tank omits any of the array of holes.

14. The water heating system of claim 1, wherein the dip tube is configured to discharge the water such that a first hour rating of the water heater system with the dip tube is from about 1 percent to about 10 percent greater than a first hour rating of a water heater system having an otherwise identical dip tube with an open second end and no holes.

* * * * *